United States Patent [19]

Taylor

[11] 4,263,486

[45] Apr. 21, 1981

[54] ROTARY OPERATOR

[76] Inventor: Glenn R. Taylor, 108 Duncan Cir., Beaver, Pa. 15009

[21] Appl. No.: 14,564

[22] Filed: Feb. 23, 1979

Related U.S. Application Data

[63] Continuation-in-part of Ser. No. 13,665, Feb. 21, 1979, and a continuation-in-part of Ser. No. 13,664, Feb. 21, 1979.

[51] Int. Cl.[3] ..... H01H 3/00

[52] U.S. Cl. ..... 200/17 R; 74/567; 200/153 L

[58] Field of Search ..... 200/17 A, 17 B, 17 R, 200/18, 153 L, 153 LA, 153 LB, 307; 74/567

[56] References Cited

U.S. PATENT DOCUMENTS

| | | | |
|---|---|---|---|
| 2,748,208 | 5/1956 | Koertge | 200/16 A |
| 2,798,908 | 7/1957 | Frank et al. | 200/18 |
| 4,052,582 | 10/1977 | Mullen | 200/18 |
| 4,175,220 | 11/1979 | Johnston et al. | 200/18 |

*Primary Examiner*—J. V. Truhe
*Assistant Examiner*—Morris Ginsburg
*Attorney, Agent, or Firm*—Webb, Burden, Robinson & Webb

[57] ABSTRACT

A rotary operator for use with an electrical contact block includes a housing having a base portion and a hollow cylindrical extension having external threads on an end opposite the base portion, and a rotatable stem assembly disposed in the base portion and extension. The stem assembly comprises a control knob secured to one end of an intermediate member and a cam member secured to the opposite end. A clamp ring threaded to the extension retains stem assembly in the housing. Multiple position, and more particularly, two and three position cam members having novel camming surfaces are disclosed.

5 Claims, 7 Drawing Figures

ROTARY OPERATOR

CROSS REFERENCE TO RELATED APPLICATIONS

This application is a continuation-in-part of two applications: Ser. No. 013,665, filed Feb. 21, 1979, entitled "CONTACT BLOCK" and Ser. No. 013,664, filed Feb. 21, 1979, entitled "PUSHBUTTON OPERATOR".

FIELD OF THE INVENTION

This invention relates to rotary operators, and particularly to operators which are suitable for engaging the operating mechanism of electrical contact blocks to make and break electrical circuits. A preferred form of contact block is disclosed in my related application Ser. No. 013,665, filed Feb. 21, 1979, entitled "CONTACT BLOCK", the disclosure of which is incorporated herein by reference and made a part hereof.

The present invention is an alternative to the pushbutton linear operator, disclosed in my related application Ser. No. 013,664, filed Feb. 21, 1979, entitled "PUSHBUTTON OPERATOR", the disclosure of which is also incorporated herein by reference and made a part hereof. The rotary operator of the present invention utilizes the same housing as is used in the pushbutton operator disclosed in said application, but includes components which permit rotation of a stem assembly into various positions to move a stroker of the contact block to make or break the circuit through the contact block.

BACKGROUND OF THE INVENTION

Rotary operators or rotary selector switches are used to control electrical contact blocks or switches which are linearly operated. In the past, however, such operators have included cam members to translate the rotary motion of a handle to a linear motion to operate the contact blocks. In addition, separate members have been used around or above or behind the cam member to provide a detent arrangement to properly position the cam surface when the control knob is rotated. The use of such a detent arrangement requires multiple moving parts which complicate manufacture and assembly of the rotary operators. In the present invention, the cam surface is so designed that it operates directly against the operating extension or projection of the stroker or strokers of the contact block or blocks secured to the operator and provides the detent function.

SUMMARY OF THE INVENTION

In a rotary operator for use with an electrical contact block wherein the operator includes a housing having a base portion and a hollow extension having external threads on an end opposite the base portion, a rotatable stem assembly disposed in the housing which comprises a control knob secured to one end of an intermediate member and a cam member secured to the opposite end. A clamp ring threaded to the extension retains the stem assembly in the housing. Multiple position and preferably two and three position cam members having novel camming surfaces cooperate directly with the stroker or strokers of a contact block or blocks connected to the operator to position the movable contacts of the contact block or blocks properly with respect to the stationary contacts of the block or blocks to make or break an electrical circuit.

DETAILED DESCRIPTION OF PREFERRED EMBODIMENTS OF THE INVENTION

Figure 1:
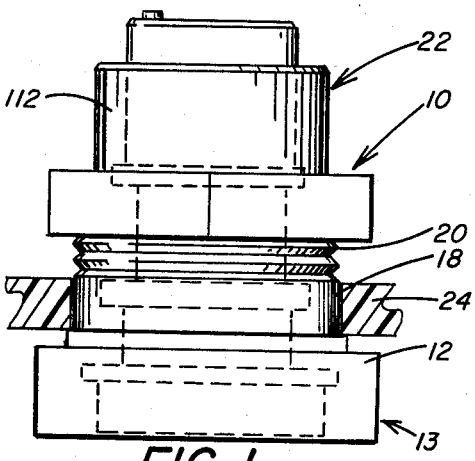
FIG. 1 is an elevation view of a rotary operator in accordance with the invention.

Referring to FIGS. 1–5, a rotary operator 10 comprises a housing 13 made of insulating thermoplastic material formed by a base portion 12 and an upwardly extending hollow cylindrical extension 18. The upper end of the extension 18 has external threads 20. A clamp ring 22 having internal threads 23 is adapted to be tightened on the extension 18 against a panel 24 to mount the operator, using mounting gaskets, if necessary. The clamp ring 22 includes an upwardly extending sidewall 112.

Figure 2:
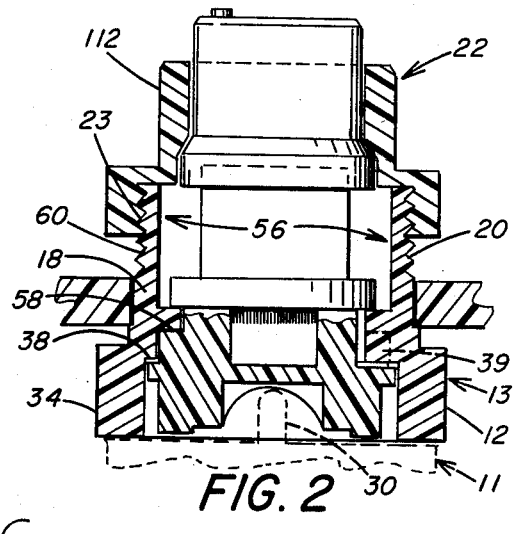
FIG. 2 is a cross-sectional view taken along the vertical plane through the vertical axis of the operator of FIG. 1.
Figure 3:
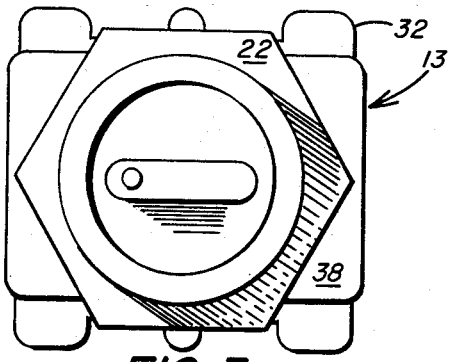
FIG. 3 is a top plan view of the operator shown in FIG. 1.
Figure 4:
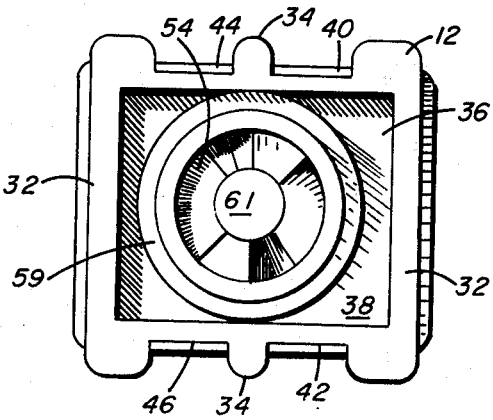
FIG. 4 is a bottom plan view of the operator of FIG. 1 showing a cam surface.

The base portion 12 is adapted to be connected to a contact block 11 (a portion of which is shown in FIG. 2), such as the block identified by the numeral 10 in my co-pending application entitled "CONTACT BLOCK", by arms which extend from the housing of the contact block and connect to the base portion 12 of the operator. As fully described in said co-pending application the arms 14 are adapted to extend into notches 40, 42 or 44, 46 of the sidewalls 34 of the base portion, such that two contact blocks can be mounted in parallel on a single operator with the projections 30 on the strokers thereof extending outwardly within the confines of walls 32, 34 of the base portion 12 of the operator. The base walls 32 and 34 define a central opening 36, which is preferably rectangular, and has a top wall 38. The hollow cylindrical extension 18 is integrally formed on the upper surface of the top wall 38. The bore 56 of the extension communicates with the opening 36. An annular ring 58 extends radially into the bore 56 from sidewall portion 60 to provide a stop at the lower end of the extension 18. The bore 56 has an essentially constant internal diameter throughout its length from the ring 58 to the opposite end of the extension 18.

The wall 38 below the annular ring 58 forms an annular cavity having a diameter substantially equal to the diameter of bore 56. A stop 39 is located in the cavity to limit rotation of the rotatable stem assembly as will be described hereinafter.

Figure 5:
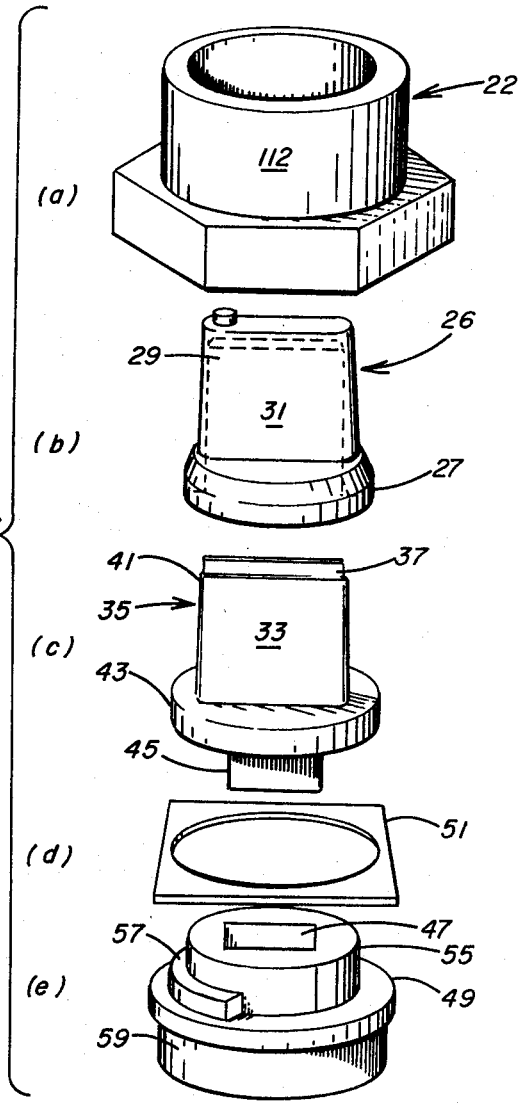
FIG. 5 is an exploded view of the stem assembly used in the operator of FIG. 1.

The elements of the stem assembly are clearly shown in FIG. 5. A control knob 26 has an annular cap member 27 and an upstanding vertical section 29. A thin vertical opening 31 is provided in the cap member into which a thin vertical portion 33 of the intermediate member 35 extends. The vertical opening 31 is of the same shape, but slightly larger than the top portion 37 of the vertical portion 33 such that the two "snap fit" together. The top portion 37 is slightly narrower than the remainder of portion 33 forming a shoulder 41 which limits the extent to which the control knob can be pushed onto the member 35.

An annular disk portion 43 of the intermediate member 35 has a diameter slightly smaller than the diameter of the bore 56 of the extension 18 such that the member 35 is rotatable within bore 56.

The bottom surface of the disk carries a rectangular, preferably square, dowel 45 which fits within rectangular opening 47 in cam member 49 and drives the cam member.

A thin wafer 51 of Teflon material may be disposed in the base portion 12 of the operator and against the top wall 38 to reduce frictional resistance between the cam member 49 and the top wall 38 of the operator.

Cam member opening 47 is formed in a circular portion 55 having a diameter smaller than the opening in the annular ring 58 in the extension 18 into which portion 55 rotatably fits.

A stop member 57 extends part way around the circumference of portion 55 and when assembled within the operator housing travels in the annular cavity in the wall 38. Abutment of the stop 39 in the cavity with one of the ends of the member 57 limits rotation of the stem assembly in the operator housing.

A cam surface 54 is provided on the underside of the cam member 49 for engagement with the projection 30 of one or two contact block strokers. The outside diameter of the cam surface is defined by depending wall 59.

The clamp ring 22 is threaded to the extension 18 to retain the control knob and intermediate member in the housing. The cam member is snapped onto the dowel of the intermediate member after the Telfon wafer is positioned in the housing.

The cam members are preferably made of an internally lubricated material such as Teflon or Teflon and/or silicone alloy having a low coefficient of friction and low abrasion characteristics.

Figure 7:
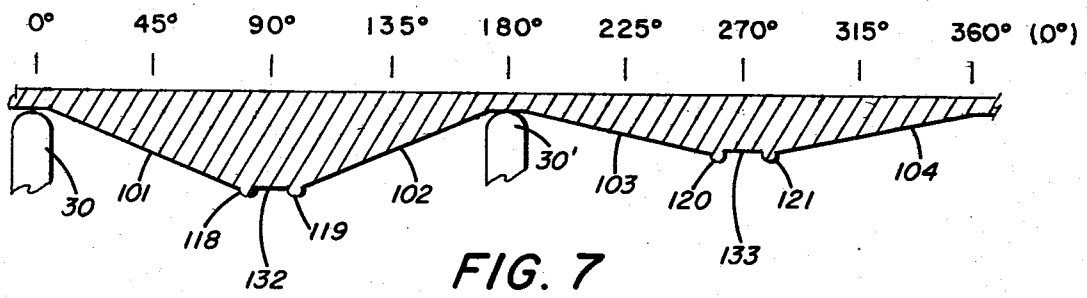
FIG. 7 is a linear representation of the three position cam surface.
Figure 6:
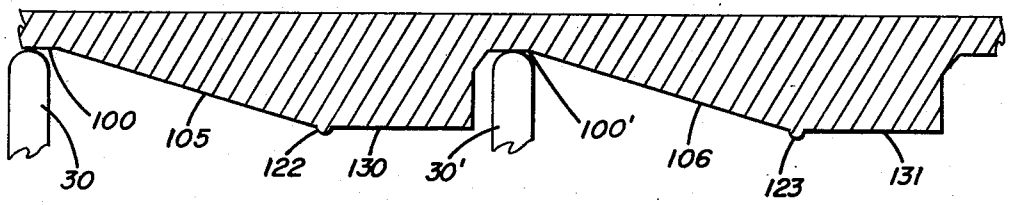
FIG. 6 is a linear representation of the two position cam surface.

FIGS. 6 and 7 illustrate in two dimensions the layout of the three-dimensional cam surfaces of the two position and three position cam surfaces of the invention, respectively. The outer diameters of the cam surfaces are the same. The central openings 61 are the same such that the width of the ramps 101–106 of the two and three position cams are the same.

Each of the two and three position cams is characterized by the feature that at the uppermost point of each ramp 101–106 there is a slight extension or "bump" 118–123 over which the projection on the stroker of the contact block must pass. These bumps 118–123 in the herein described embodiments are preferably between approximately 0.010" and 0.015" in height. The general rule is that the bump height should be sufficient to cause a perceptible exertion of operating force on the stroker extension but less than the overtravel of the contacts. Preferably the bump height should be between 15 to 30% of the overtravel of the control block. When the control knob is rotated turning the cam, the projection will ride on and follow the cam surface. Unless the cam surface is rotated sufficiently to permit the projection to pass over the bump at the top of a ramp and detent, i.e. hold the rotated cam in position, the projection will always tend to return to the bottom of the ramp. This is particularly important in that a normally open contact block will always tend to return to the open position unless the operator is rotated sufficiently to select the closed position by causing the projection to pass over a bump on the cam surface. Hence, any equipment on the circuit through the contact block will be restrained from operating accidentally.

Referring particularly to FIG. 6, the position cam surface layout shows a projection 30 of a first stroker of a contact block at the low dwell or 0° position and a projection 30' of a second stroker of the contact block at the other low dwell or 180° position. In this position the projections are fully extended to the bottom 100 and 100' of the cam surface and a normally open contact block is open. As the stem assembly is rotated, the cam surface is rotated, (as viewed in the drawings it appears to move from right to left) the projection 30 ascends ramp portion 105 and projection 30' ascends ramp portion 106 to approximately the 120° and 300° position, respectively. When the projections 30, 30' reach the uppermost points on their respective ramp portions 105 and 106, their respective strokers are nearly fully depressed against the spring force in the contact block. At the uppermost points, the projections 30, 30' encounter bumps 122 and 123, respectively. Continued rotation of the control knob causes the bumps to pass over their respective projections 30, 30' and seat on high dwell portions 130 and 131, respectively of the camming surface. At this point, the contact blocks are closed electrically and the stops engage. Counter rotation of the control knob moves the projections 30, 30' back over their respective bumps 122 and 123 down the ramp portions 105 and 106 to the bottom 100 and 100' where the normally open contact block is again open. It will be noted that the ramps run in the same direction to provide cooperating forces to rotate the cam and return the contacts to their normal position when the projections are positioned anywhere along the ramp.

The three position cam surface layout will also be described with reference to projections 30 and 30' of strokers of two contact blocks connected to the operator. In this case, each ramp portion extends approximately 90° with a dwell portion at each end. Beginning with the projections 30, 30' at the low dwell or 0° and 180° position respectively (whereat the projection is fully extended from its contact block), upon rotation of the cam surface in a right to left direction on FIG. 7, projection 30 ascends ramp 101 and projection 30' ascends ramp 103 to their respective uppermost points. Since ramp 101 is steeper than ramp 103, it will be noted that projection 30 is nearly fully depressed when it reaches bump 118 at the top of ramp 101, while projection 30' is only depressed midway. In other words, applied to normally open contact blocks, the contact block with projection 30 will be fully closed as soon as projection 30 passes over bump 118 onto high dwell portion 132 of the camming surface at 90°. On the other hand, since the projection 30' is only depressed midway over bump 120 onto dwell portion 133 at 270°, no connection is made through the contact block since the movable and stationary contacts therein are not in engagement.

Upon further rotation of the control knob the projections 30, 30' pass over bumps 118 and 120 respectively, and rest on high and intermediate dwell points 132 and 133. Further rotation is prevented by the stop 57 on the cam member 49 engaging stop 39 in the cavity of the housing.

Counter rotation of the control knob moves the projections 30 and 30' over their respective bumps 118 and 120 down the ramp portions 101 and 103 where a normally open contact block would again be open or a normally closed contact block would again be closed. It will be noted that the ramps run in the same direction as previously described to provide cooperating forces to compel the contacts to return to the normal position.

As can be readily observed from FIG. 7, the cam may be rotated in an opposite direction from that described, i.e. left to right, to provide a different contact sequence of contact blocks using ramps 102, 104, and bumps 119, 121 respectively with stroker 30 being operated to engage mid-dwell surface 133 (instead of 132) and stroker 30' being operated to engage high dwell surface 132 (instead of 133). It will be observed that, upon either direction of rotation of the camming surface, the projections always move in the same direction, that is on an ascending ramp, a descending ramp or in a dwell. In this manner, the spring force of the contact block is consistently assisted or resisted.

Having described preferred embodiments of the invention, it is to be understood that it may be otherwise embodied within the scope of the appended claims.

I claim:

1. In a rotary operator for use in controlling electrical contact blocks having a projection therein for engagement with the operator which includes a housing and a rotatable stem assembly within said housing, the stem assembly having a means for controlling rotation of the stem and a surface for engagement with the projection, the improvement in the surface for engagement with the projection comprising:

an annular camming surface having at least one high dwell portion and at least one low dwell portion, said high dwell portion and said low dwell portion being connected by a ramp and a bump raised above the high dwell portion proximate the intersection of the high dwell portion and the ramp.

2. The rotary operator of claim 1 wherein said annular camming surface has two high dwell portions, two low dwell portions and two ramps and at least one bump proximate the intersection of one high dwell portion and one ramp.

3. The operator of claim 2 wherein two bumps are provided proximate each intersection of a ramp and a high dwell portion.

4. The operator of claim 2 wherein said high dwell portions and said low dwell portions are linearly opposed.

5. The rotary operator of claim 1 including an intermediate dwell portion and two low dwell portions, first two ramps connecting said low dwell portions with said high dwell portion and first two bumps proximate the intersection of the high dwell portion and the first two ramps; second two ramps connecting said low dwell portions and said intermediate dwell portion, and second two bumps proximate the intersection of the intermediate dwell portion and the second two ramps.

* * * * *